US008590083B2

(12) United States Patent
Rhodes

(10) Patent No.: US 8,590,083 B2
(45) Date of Patent: Nov. 26, 2013

(54) LAUNDRY APPLIANCE

(75) Inventor: David Charles Rhodes, Auckland (NZ)

(73) Assignee: Fisher & Paykel Appliances Limited, Auckland (NZ)

( * ) Notice: Subject to any disclaimer, the term of this patent is extended or adjusted under 35 U.S.C. 154(b) by 1068 days.

(21) Appl. No.: 12/520,202

(22) PCT Filed: Dec. 20, 2007

(86) PCT No.: PCT/NZ2007/000392

§ 371 (c)(1),
(2), (4) Date: Sep. 14, 2009

(87) PCT Pub. No.: WO2008/075987

PCT Pub. Date: Jun. 26, 2008

(65) Prior Publication Data

US 2010/0011515 A1 Jan. 21, 2010

(30) Foreign Application Priority Data

Dec. 21, 2006 (NZ) ..... 552422

(51) Int. Cl.
*D06F 39/00* (2006.01)

(52) U.S. Cl.
USPC ..... 8/159; 8/137; 8/158; 68/12.02; 68/23 R; 68/23.1

(58) Field of Classification Search
USPC ..... 68/12.06, 23.2, 12.02, 12.04, 23.1, 68/12.16, 12.12, 139, 12.18, 23 R, 19.2, 68/24, 12.19; 8/159, 158, 137; 210/144; 74/572.4
See application file for complete search history.

(56) References Cited

U.S. PATENT DOCUMENTS

| | | | | |
|---|---|---|---|---|
| 4,513,464 | A | 4/1985 | Rettich et al. | |
| 5,280,660 | A | 1/1994 | Pellerin et al. | |
| 6,363,756 | B1 | 4/2002 | Seagar et al. | |
| 6,477,867 | B1 | 11/2002 | Collecutt et al. | |
| 7,530,133 | B2 * | 5/2009 | Mitts | 8/159 |
| 2005/0284192 | A1 * | 12/2005 | Altinier et al. | 68/12.06 |

FOREIGN PATENT DOCUMENTS

| | | | | |
|---|---|---|---|---|
| EP | 0 071 308 | | 2/1983 | |
| EP | 0 361 775 | | 4/1990 | |
| EP | 0 732 436 | | 3/1995 | |
| EP | 0 704 567 | | 4/1996 | |
| EP | 0 732 436 | A1 * | 9/1996 | G06F 35/00 |
| EP | 0732436 | * | 9/1996 | D06F 35/00 |
| EP | 0 856 604 | | 8/1998 | |
| GB | 2 322 141 | | 8/1998 | |
| JP | 10-174797 | | 6/1998 | |
| WO | 00/28128 | | 5/2000 | |
| WO | 00/39382 | | 7/2000 | |

* cited by examiner

*Primary Examiner* — Eric Golightly
*Assistant Examiner* — Thomas Bucci
(74) *Attorney, Agent, or Firm* — Clark Hill PLC

(57) ABSTRACT

A laundry appliance having a perforated rotatable drum for spin dehydrating a wet textile load, an electric motor for providing an accelerating force which in use causes the drum to rotate, load sensors for detecting any static dynamic imbalance in the rotation of the drum, and a controller which receives inputs from the load sensors and is programmed to, in a spin-up phase, energize said electric motor so as to evenly distribute the load within the drum and thereby minimize any static or dynamic imbalance when the drum rotates.

6 Claims, 13 Drawing Sheets

LAUNDRY APPLIANCE

This application is a U.S. National Phase filing of PCT/NZ2007/000392, having an International filing date of Dec. 20, 2007 which was published in English on Jun. 26, 2008 under International Publication No. WO 2008/075987 which claims the benefit of New Zealand Patent No. 552422, filed on Dec. 21, 2006, all of which are hereby incorporated by reference in their entirety.

BACKGROUND TO THE INVENTION

1. Field of the Invention

This invention relates to a system for balancing the load in a horizontal axis washing machine.

2. Summary of the Prior Art

Conventional horizontal axis washing machines involve a final spin cycle to extract as much water from washed articles as possible to reduce drying time. However, the requirement of a high spin speed is at odds with quiet operation. At the beginning of a spin cycle the wash load can be quite severely unbalanced, so that when the machine tries to accelerate, noise and vibrations result.

The means that washing machine designers have employed so far to cater for imbalance in the load, is typically to suspend the internal assembly on springs and dampers in order to isolate its vibration. The difficulty is that these suspension assemblies never isolate the vibration completely. As the machine ages, they deteriorate and the problem gets worse. Also, these suspension assemblies require significant internal clearance, and so valuable load capacity is lost when designing a machine to standard outside dimensions. Further, because the internal assembly must still withstand the forces due to the imbalance, considerable extra costs result.

The ideal approach is to eliminate the problem at its source, for which there are various solutions. The first possibility is to ensure that the wash load is evenly distributed prior to spinning. This is an effective solution but it is extremely difficult to achieve in practice. Therefore while steps can be taken to reduce the degree of imbalance that must be catered for, it is not possible to eliminate it sufficiently to ignore it thereafter. Another approach is to determine the size and nature of the load imbalance, and add an imbalance that exactly counteracts the load imbalance.

Methods of compensating for imbalance in horizontal axis washing machines have been disclosed in U.S. Pat. No. 5,280,660 (Pellerin et al.), European Patent 856604 (Fagor, S. Coop). These disclosures relate to the use of three axially orientated chambers running the length of the drum, displaced evenly around the periphery of the drum. When individually filled with water in the appropriate amounts, the chamber can be used to approximately correct imbalances in the axis of rotation.

In our published PCT application WO 00/39382 we described a balancing system for washing machines that compensates for both static and dynamic imbalance. That system is sufficiently accurate that the traditional suspension can be dispensed with.

However, even with that system a load may be sufficiently unbalanced at the early part of the spin cycle that it is not possible to adequately compensate for the imbalance using the active balancing system. Also, different wash items have different water holding properties. As water is extracted in the spin cycle this can lead to a changing imbalance during the spin cycle. Water additions to the balance chambers are not reversible during the spin cycle, so rebalancing leads to an ongoing accumulation until the fill capacity is reached. In combination with a poor initial imbalance, this can lead to occasional inability to reach full spin speed. This in turn requires a fairly strictly controlled initial imbalance, which may in turn require many distribution attempts at the commencement of a spin cycle.

SUMMARY OF THE INVENTION

It is an object of the present invention to provide a balancing system for a horizontal axis washing machine which goes as far as is practical for its purpose towards overcoming the above mentioned disadvantages.

In a first aspect, the present invention may be broadly said to consist in a laundry appliance comprising:

a perforated rotatable drum for spin dehydrating a wet textile load, driving means for providing an accelerating force which in use causes said drum to rotate, imbalance sensing means for detecting any static dynamic imbalance in the rotation of said drum, and a digital processor which receives inputs from said imbalance sensing means and is programmed to, in a spin-up phase, energise said driving means so as to evenly distribute the load within said drum and thereby minimise any static or dynamic imbalance when said drum rotates.

Preferably, during a low speed rotation of said drum in which said load is tumbling within said drum, said digital processing monitors said imbalance sensing means for a first condition, and on detecting said first condition immediately accelerates said drum to a higher speed wherein said load is held centrifugally against the drum.

Preferably, said processor is programmed with software which causes it to carry out the following steps:

(a) energise said driving means to rotate said drum at a first predetermined rotational speed whereby said load is tumbling;

(b) monitor said imbalance sensing means;

(c) continually determine one or more characteristic indexes of said input from said imbalance sensing means; and (d) determine the presence of said first condition by comparing said indexes with a first criteria.

Preferably said first criteria is preset.

Preferably said processor monitors said imbalance sensing means after accelerating said drum to said second speed, and if the input from said sensing means indicates that said imbalance is greater than a predetermined threshold then said processor allows said drum to decelerate to said first speed and thereafter re-execute said spin-up phase.

Preferably said processor is programmed to repeat said cycle of executing said spin-up phase and detecting imbalance at said second speed until said imbalance at said second speed is less than a threshold value.

Preferably said threshold value is preset, but is modified upward in accordance with repeated failure to reach a value below said threshold value.

Preferably said digital processor is programmed to stop said cycling if said threshold value is not reached within a predetermined number of cycles or within a predetermined time, and is programmed to thereafter perform a spin operation within the limits of its ability to handle the imbalanced load.

Preferably said imbalance sensing means senses vertical forces on said drum, at least a component of said inputs from said imbalance sensing means represents said vertical forces on said drum, and said processor is programmed to detect within a single revolution of said drum at said first speed that throughout the period of said rotation that the forces created by the tumbling load within said drum are evenly distributed.

Preferably said processor is programmed to calculate a measure of distribution of said forces for a moving time window corresponding at all times with the immediately preceding revolution of said drum.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

BRIEF DESCRIPTION OF THE DRAWINGS

One preferred form of the present invention will now be described with reference to the accompanying drawings.

DETAILED DESCRIPTION

Figure 1:
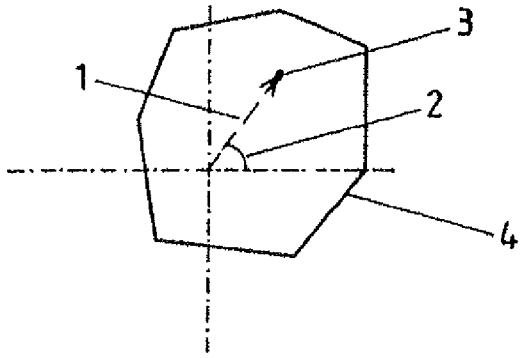
FIG. 1 is an illustration of the concept of static imbalance.
Figure 2:
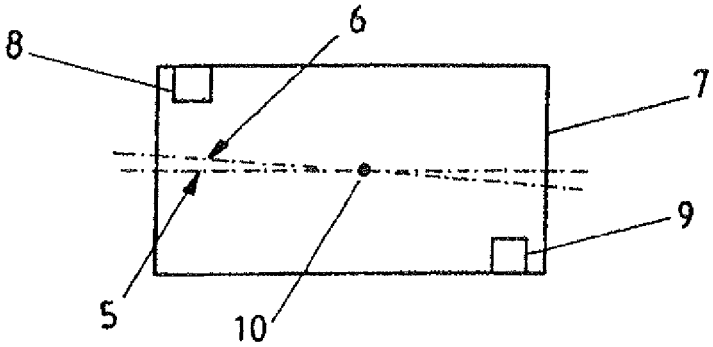
FIG. 2 is an illustration of the concept of dynamic imbalance.
Figure 3:
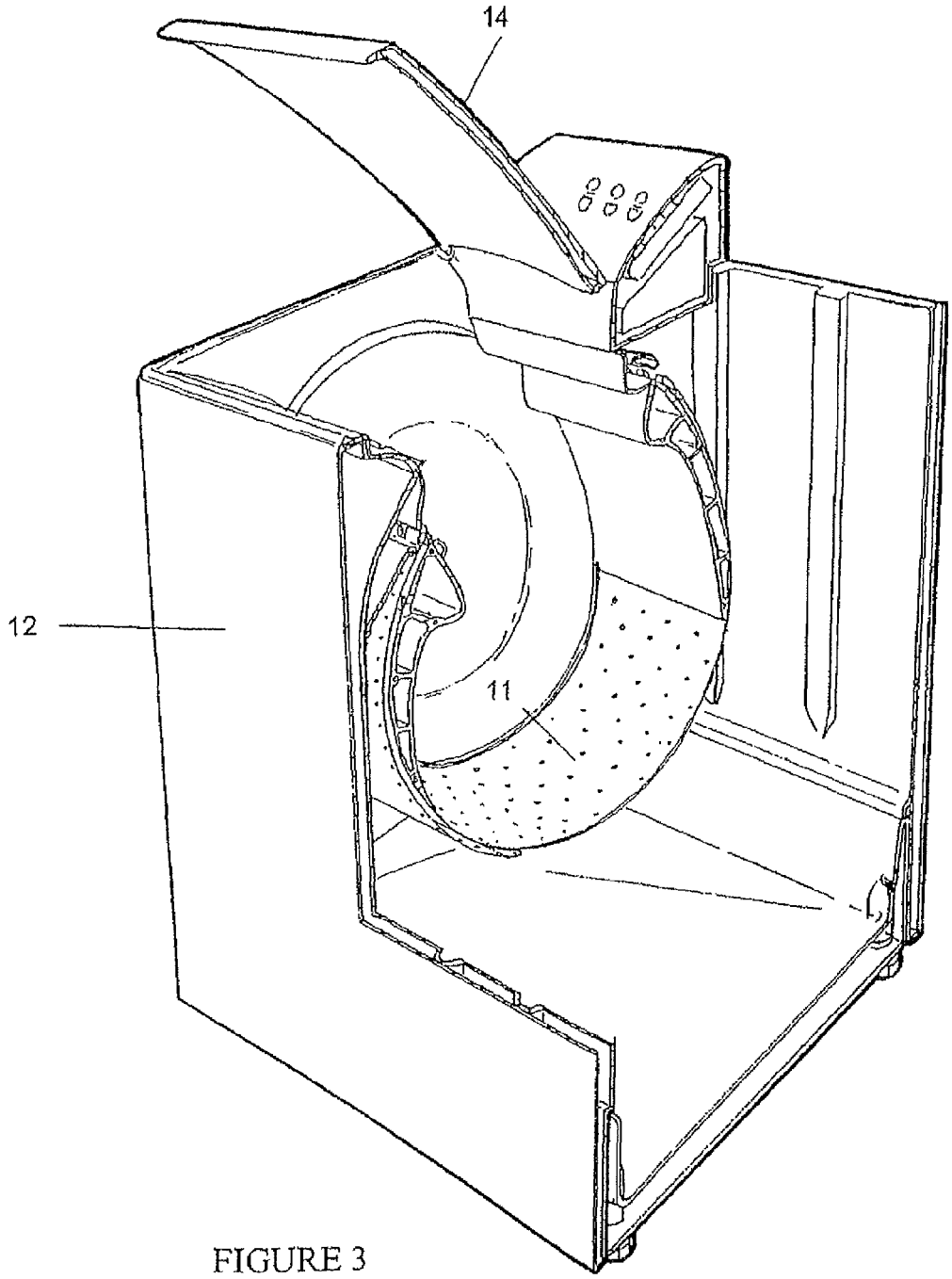
FIG. 3 is a cutaway perspective view of a washing machine according to the present invention with the cutaway to show the machine substantially in cross section.
Figure 4:
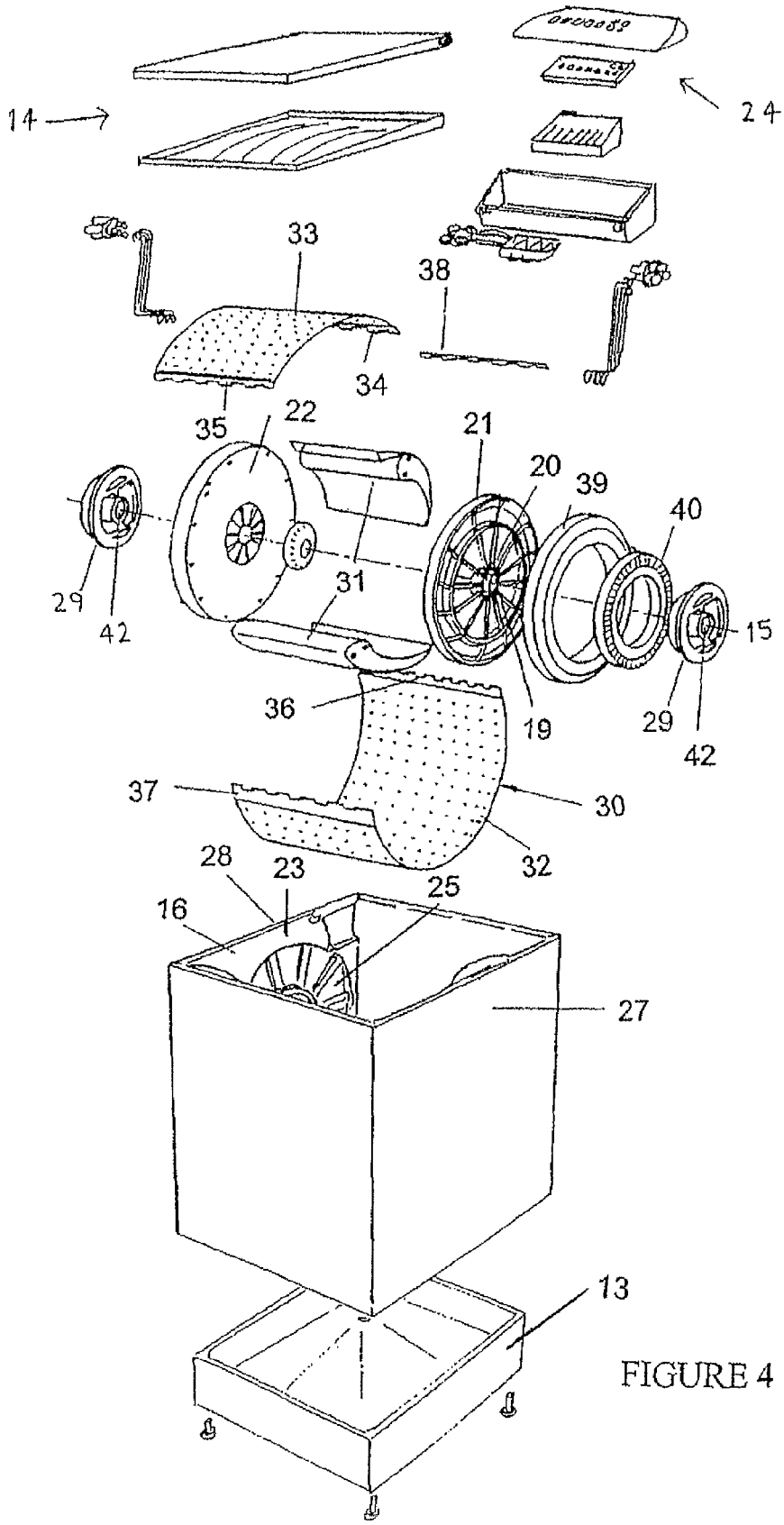
FIG. 4 is an assembly drawing in perspective view of the washing machine of FIG. 3 showing the various major parts that go together to form the machine.

The present invention will be described primarily with reference to a laundry washing machine constructed in accordance with our PCT application WO00/39382 although many of the principles are equally applicable to laundry drying machines incorporating active balancing systems which sense the out of balance force acting on the drum. FIGS. 3 and 4 show a washing machine of the horizontal axis type, having a perforated drum 11 supported with its axis substantially horizontal. In the preferred arrangement the drum is arranged in a side-to-side orientation within a cabinet 12 and accessed through the side wall of the drum.

The cabinet 12 includes surfaces which confine wash or rinse liquid leaving the drum within a water tight enclosure. Some parts of the cabinet structure 12 may be formed together with the liquid confining surfaces by for example twin-sheet thermoforming. Alternatively the drum may be enclosed in a container separate from the cabinet structure. The container can be mounted essentially rigidly with respect to the cabinet structure.

The cabinet may be a closed structure suitable for a stand alone environment or an open framework that can be installed in a cavity in kitchen or laundry cabinetry.

The laundry handling system including the drum and other components is preferably arranged in a top loading configuration. In FIG. 3 the horizontally supported drum 11 is contained within a substantially rectangular cabinet 12 with access being provided via a hinged lid 14 on the top of the machine. Other top loading horizontal axis configurations are described in our U.S. Pat. No. 6,363,756, the contents of which is hereby incorporated by reference. Other horizontal axis configurations may be adopted, such as front loading embodiments. In this later case the drum will typically be supported in a cantilever fashion by bearings located at two places on a shaft extending from one end.

In the illustrated arrangement the drum 11 is rotatably supported by bearings 15 at either end which in turn are each supported by a drum support 16. In the embodiment depicted the bearings are located, externally, on a shaft 19 protruding from the hub area 20 of the drum ends 21, 22.

Other axial configurations are equally possible for example the bearings may be internally located in a well in the outer face of the hub area of the drum to be located on a shaft protruding from the drum support.

The drum supports 16 are shown each as a base supported unit. The drum supports may have integrated form, which again is ideally suited to manufacture by twin sheet thermoforming, injection moulding, blow moulding or the like, or may be fabricated, for example by pressing or folding from steel sheet. Each drum support preferably includes a strengthening rib area 23 and a drum accommodating well area 25 as depicted to accommodate the respective drum end 21, 22 of the drum 1.

The illustrated drum supports 16 engage with a sub-structure by interlocking within complementary surfaces provided in side walls 27, 28. Other constructions are possible, such as frameworks formed from individual members or the drum support could comprise a wash enclosure substantially enclosing the drum and which is in turn supported in said cabinet. The wash enclosure may include bearing mounts at either end. The wash enclosure can be solidly supported on a base of the cabinet with no need for suspension, and no need to accommodate movement between the tub and the cabinet adjacent the user access opening.

The illustrated drum supports 16 each include a bearing support well at the centre of the well area 25. A bearing mount 29 is located within the bearing support well, and in turn the bearing 15 fits within a boss in the bearing mount 29.

These structural details are only one illustrative embodiment and do not constitute part of the present invention. For example, the bearings or shafts may be mounted to the wall of a container that substantially surrounds the drum.

In the illustrated embodiment of the laundry machine, as shown in more detail in FIGS. 3 and 4, the drum 11 comprises a perforated metal hoop 30, a pair of ends 21, 22 enclosing the ends of the hoop 30 to form a substantially cylindrical chamber and a pair of vanes 31 extending between the drum ends 21, 22.

In the illustrated embodiment of the laundry machine the drum is driven only from one end 21 and consequently one function of the vanes 31 is to transmit rotational torque to the non-driven drum end 22. The vanes also provide longitudinal rigidity to the drum assembly 11. To these ends the vanes 30 are wide and shallow, although they have sufficient depth and internal reinforcing to provide resistance to buckling due to unbalanced dynamic loads. The vanes 30 have a distinct form, including a leading and trailing edge to assist in tumbling the washing load. The vanes 30 are oriented oppositely in a rotational direction, so that under rotation in either direction one vane is going forwards and the other backwards.

This drum structure is only illustrative and does not constitute part of the present invention. For example the drum may be constructed from multiple lengths of perforated steel secured to a framework including a part of drum ends and a number of traverse ribs spanning between the ends.

In the illustrated embodiment of the washing machine incorporating the invention, access to the interior of the drum 11 is provided through a sliding hatch section 33 in the cylindrical wall 30 of the drum. The hatch section is connected through a latching mechanism 34, 35, 36, 37, 38 such that remains closed during operation. The cabinet 12 of the washing machine is formed to provide access to the drum 11 in a substantially top loading fashion, rather than the traditional front loading fashion more common to horizontal axis machines, where access is provided through one end of the drum.

This arrangement is only illustrative. The present balancing system was also used with other opening configurations, such as front loading, or as outlined in our U.S. Pat. No. 6,363,756.

The general configuration of a wash control system will be described with reference to FIGS. 4 and 7.

The washing machine includes an electric motor 701 (rotor 39 and stator 40 visible in FIG. 4) to effect rotation of the drum during all phases of operation (wash, rinse and spin dry). In the preferred embodiment of the washing machine the motor is a direct drive inside-out electronically commutated brushless dc motor. The motor has a permanent magnet rotor 39 coupled to one end 21 of the drum 11 and a stator 40 coupled to the drum support 16. The rotor may secure directly to the drum or may alternatively be secured to one of the supporting shafts. These options are also available in the case of a front loading machine incorporating the present invention. A suitable motor is described in EP0361775 and in many other patents dealing with motor drive systems for laundry machines.

A water supply system applies wash water to the laundry load. The water supply system may be of conventional type, adding water to a sump to reach a level at which the lower portion of the rotating drum is immersed in the wash liquid. The system may include valves 401 supplying water to the sump through selected chambers of a flow through dispenser 403. Alternatively, or in addition, wash liquid may be circulated by a water pump 703 from a sump 405 to be applied directly onto the clothes load in the drum. For example by spraying from nozzles in the drum ends. In the illustrated embodiment this requires a liquid supply path to the rotating drum, for example through a hollow supporting shaft. In a front loading embodiment a spray nozzle could be mounted to the stationary structure that encloses the open front.

The water supply system generally comprises a water supply spigot for receiving a water supply at the machine, a flow control valve capable of at least on and off operation and necessary supply conduits within the machine. The laundry machine may be adapted for warm or hot wash operations, in which case a hot water receiving spigot and valve may be included, or a heater 705 may be included, for example in the pump, to heat water in the sump or circulating in the machine.

A drain pump 703 is provided below the pump to receive water from the wash sump and pump the collected water to a drain pipe. The drain pump 703 may double as a wash pump for water recirculation, if included.

A motor controller receives inputs from a position sensor 52. The position sensor may be arranged adjacent the motor, for example a Hall sensor board sensing passing permanent magnet poles or a suitable encoder. Alternatively, the position sensor may operate using back EMF or current sensing or both in relation to the motor windings. The position sensor may comprise software of the controller analysing feedback from the motor. The motor controller generates motor drive signals to activate commutation switches to selectively apply current to windings of the motor. The motor controller responds to instruction from a main control to increase or decrease the motor torque. The main control may be software executed on the same controller or may be executed on a distant controller. The motor controller may control motor torque by increasing or decreasing the effective drive current or altering the phase angle of the applied current relative to the rotor position or both.

A user interface 24 is provided, allowing user control over the functions and operation of the machine. The control microprocessor is provided within the interface module, and provides electronic control over the operation of the machine, including operation of the motor, the water supply valves, the recirculation and/or drain pumps and any water heating element.

The controls described may be implemented as software executed on one or more micro computer based controllers, or as logic circuits loaded into programmable logic hardware, or as hard wired logic or electronic circuits or combinations of any of these, or other equivalent technologies.

Balancing System

In the present invention the forces caused by an out-of-balance load during high speed rotation of drum 11, for example during, spin drying, are minimised by a dynamically controlled balancing system.

A collection of sensors provide outputs to a controller. The controller processes the sensor outputs to calculate imbalance data which in turn is used to take balance correction measures.

In one embodiment each bearing mount is configured to include a vertically acting force sensor that senses the vertical support on the bearing. The mount also preferably includes an acceleration sensor sensing vertical acceleration of the bearing mount.

Balance Correction Measures

Figure 6:
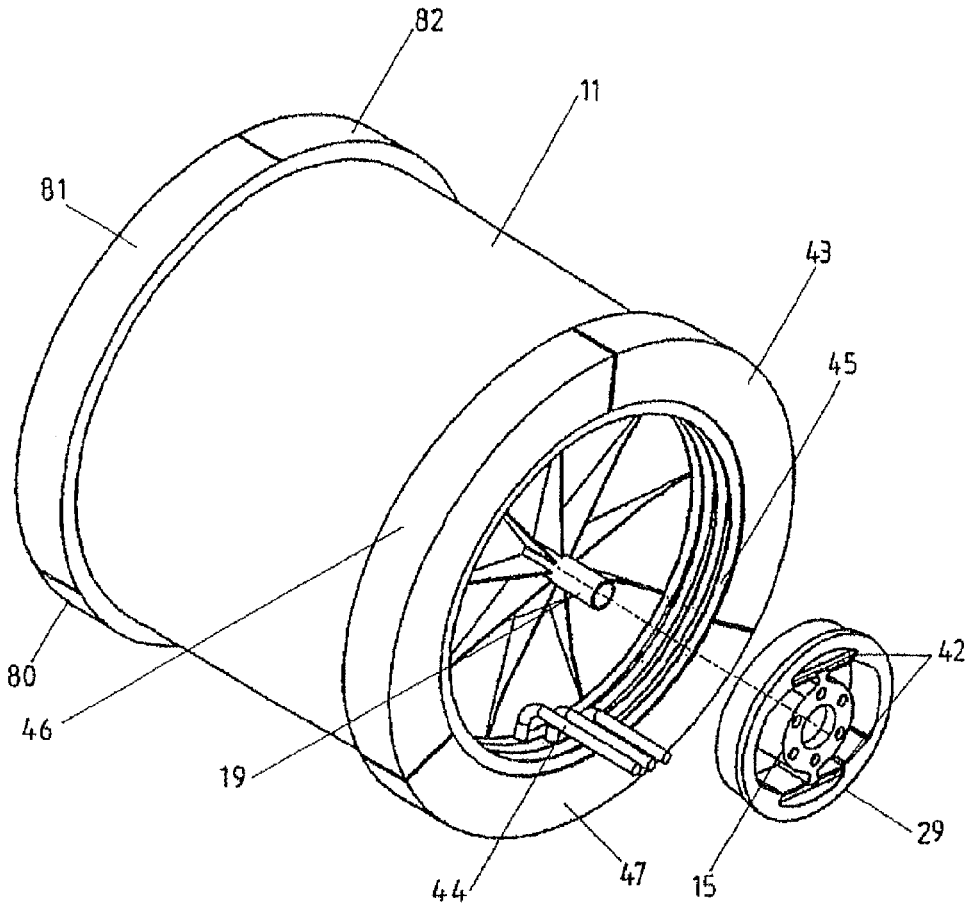
FIG. 6 is an illustration of the drum, showing the balancing chambers and sensors.

In the preferred implementation, addition of counterbalance mass is by the addition of water to one or more of the six balancing chambers 43, 46, 47, 80, 81, 82 located in the drum, as shown in FIG. 6. There are three such chambers at each end spaced 120° apart and positioned on the extremity of the drum end 21, 22.

Figure 7:
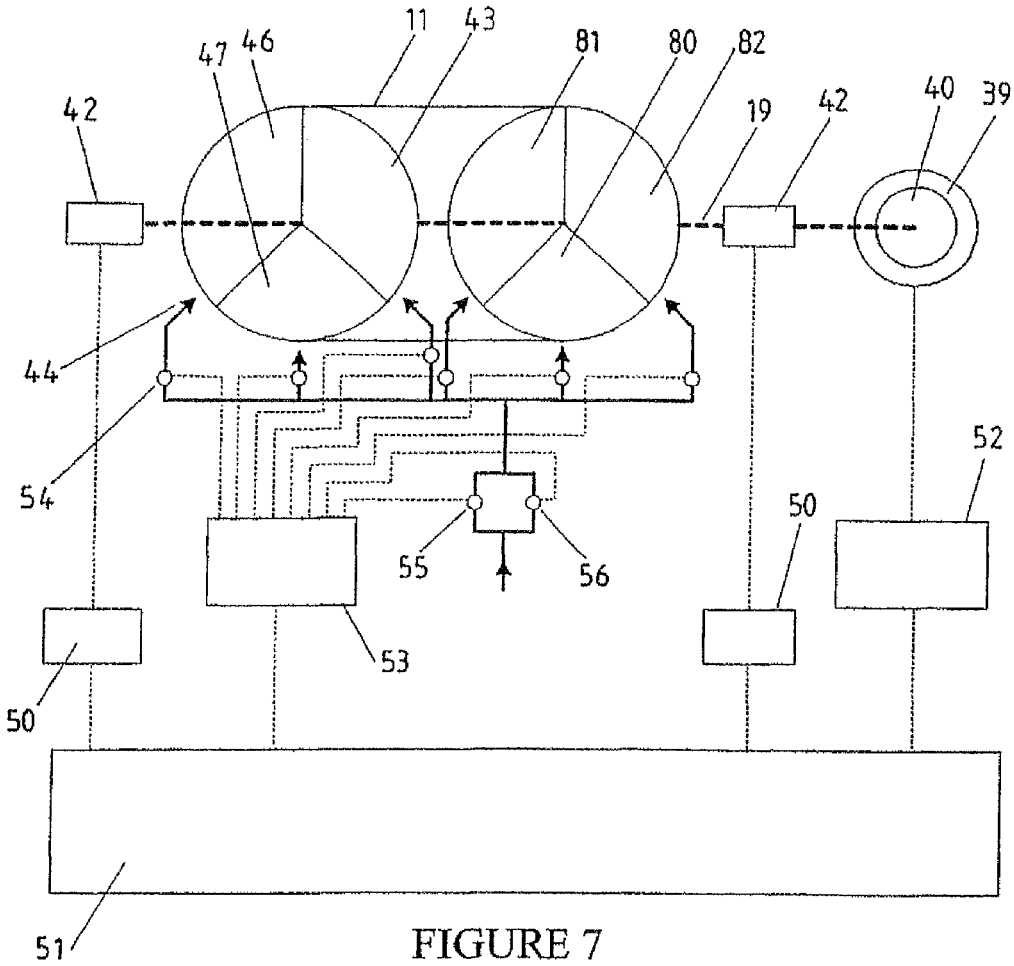
FIG. 7 is a diagrammatic representation of the liquid supply and electrical systems of the washing machine of FIG. 3.

In more detail the balancing system is illustrated in FIG. 7. The output from the load cells and accelerometers is first passed through filtering 50 before connection to the inputs of a microprocessor 51, which may be task specific or may be the main control processor for the laundry machine. The various algorithms (detailed later) programmed into the microprocessor 51, will dictate spin commands (eg: speed up/slow down) to the motor speed control and balancing corrections (eg: open/close valve 54) to the valve driver 53. The motor controller 52 in turn, will vary its energisation of the motor windings to follow the spin command. The valve driver 53 will open or close the appropriate balancing valve 54, which allows water to flow through the injector 44 into the relevant slot 45, whereupon it is channelled to the appropriate chamber. Preferably the valve driver 53 also controls of the water flow rate. For example, the valve driver may choose high or low flow valve rates, or control a pressure regulator.

Balance Correction Processing

To correct an imbalance, it is necessary to artificially add equal and opposite static and dynamic imbalances. To add a static imbalance only requires to add a certain amount of mass at some radius and rotation angle (or 'phase' angle), having effectively the same location along the spin axis as the CoG. However, to add a dynamic imbalance requires to effectively add equal and opposite compensation at two locations along the spin axis that are evenly spaced either side of the CoG. The end result is that both static and dynamic imbalances can be corrected by adding, at two separate locations along the spin axis, two independent masses (both may be at the same radius) at two independent phase angles.

Imbalance data is obtained by measuring either acceleration, velocity, force, or displacement at two independent locations on the vibrating system. These measurements are processed to calculate a vector for each end representing the out of balance force nominally acting at each counterbalance axial location. This vector is not raw signal data from the force sensors, but has been compensated for forces that result from movement of the bearing mounts.

As the nominal out of balance force (magnitude and phase angle) at each of the two locations is calculated, another process controls addition of correction mass to correct the imbalance.

Sensors

The balancing system of the preferred embodiment uses electrical signals generated by load cells in the bearing mounts and by associated accelerometers to control the application of counterbalance mass.

In the preferred embodiment a pair of load cells 42 are located with one for each end of shaft 1 as shown in FIG. 4.

Figure 5:
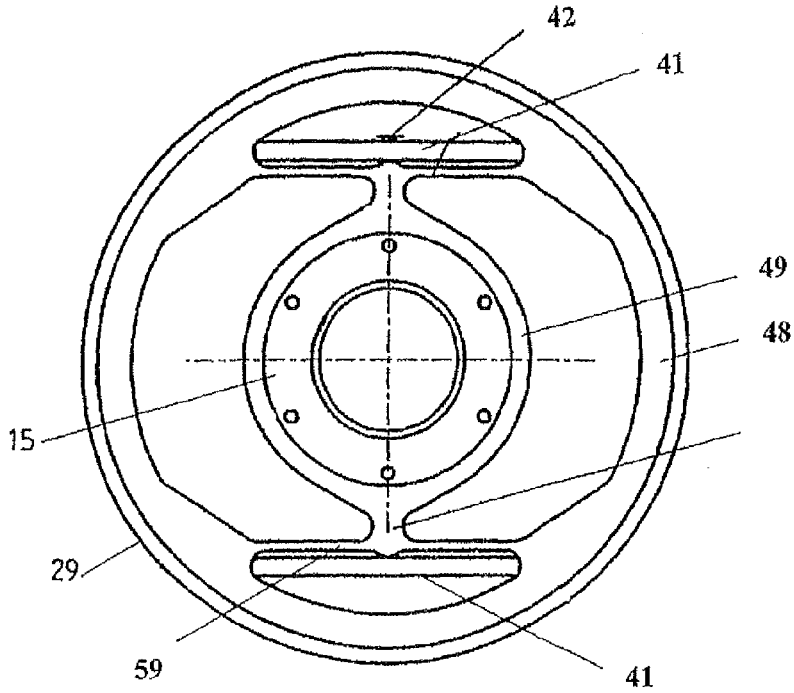
FIG. 5 is an illustration of the drum bearing mount.

The load cell may measure small displacements in a very stiff elastically deforming support system. A strain sensor suited to this application is the piezo disc. This type of sensor produces a large signal output and so is not significantly affected by RFI. Figure shows an example of a possible bearing mount. This bearing mount includes two concentric cylindrical rings 46, 47, as illustrated in FIG. 5. A pair of load bridges 40, 41 are connected at the top and bottom of the inner ring 47, respectively, and to opposite parts of the inner periphery of the outer ring 46. A piezo disc 42 is adhered to the loading bridge on the side facing the outer ring. The load from the drum is taken through a bearing 15 mounted in the internal ring 47, through the load bridges 48 and load cell 42 into the outer ring 46, and out into the external structure. It will be appreciated that in this fashion the load bridges will flex according to any vertical forces from the spinning of the drum, thus deforming the piezo disc and providing a signal representative of the imbalance force.

The load bridges are intended to flex elastically and predictably under applied vertical forces, but only through small actual displacements. For example, vertical displacement of the bearing relative to the fixed structure should be less than 10 mm. The piezo disc will have a particular response in relation to applied force. Since the out of balance force is proportional to the square of the drum speed and the response magnitude of the sensor is typically proportional to force, the relationship between sensor output and the speed of the drum is cubic. However the support geometry may present a non-linear relation between force and displacement. Either way the controller may be programmed to convert the sensor output to a force measure according to a formula that accounts for speed of rotation.

Control Algorithms

In the preferred embodiment the task of spinning while balancing is subdivided into three sub-tasks or algorithms:

Imbalance Detection Algorithm (IDA)

Balance Correction Algorithm (BCA)

Spin Algorithm (SA)

Figure 11:
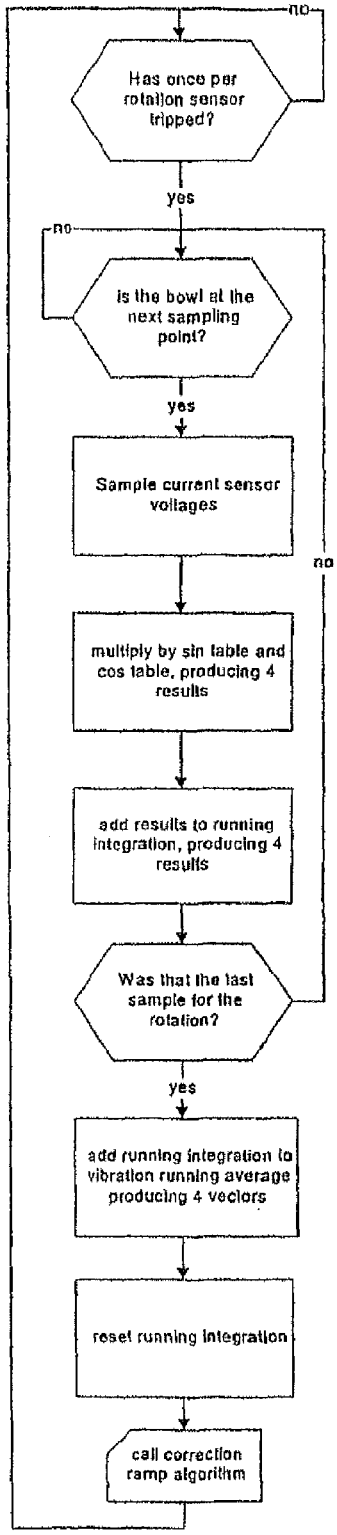
FIG. 11 is a flow diagram showing the Imbalance Detection Algorithm.

The Imbalance Detection Algorithm (IDA) (shown in FIG. 11) is concerned solely with the acquisition of imbalance related data, and is embedded in the motor control routine. This function is active whenever the motor is turning, and calculates imbalance vector data. A preferred algorithm is illustrated in FIG. 11.

Figure 13:
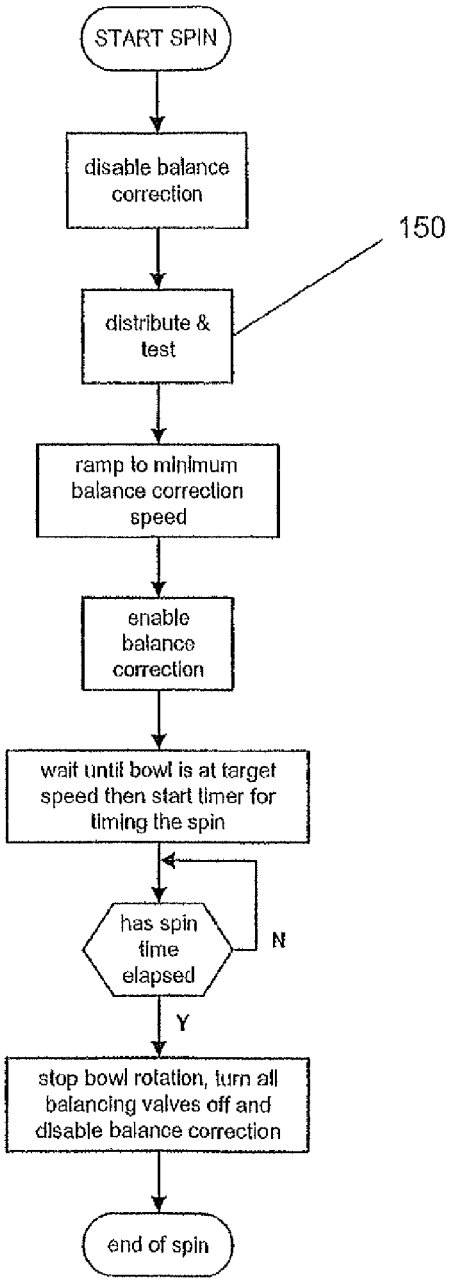
FIG. 13 is a flow diagram showing the spin cycle control algorithm.

The Spin Algorithm (SA) is concerned with executing the spin profile asked of it. The spin algorithm ramps the speed of the machine according to the profile requested and the vibration level determined by the IDA. A preferred algorithm is illustrated in FIG. 13.

Figure 12:
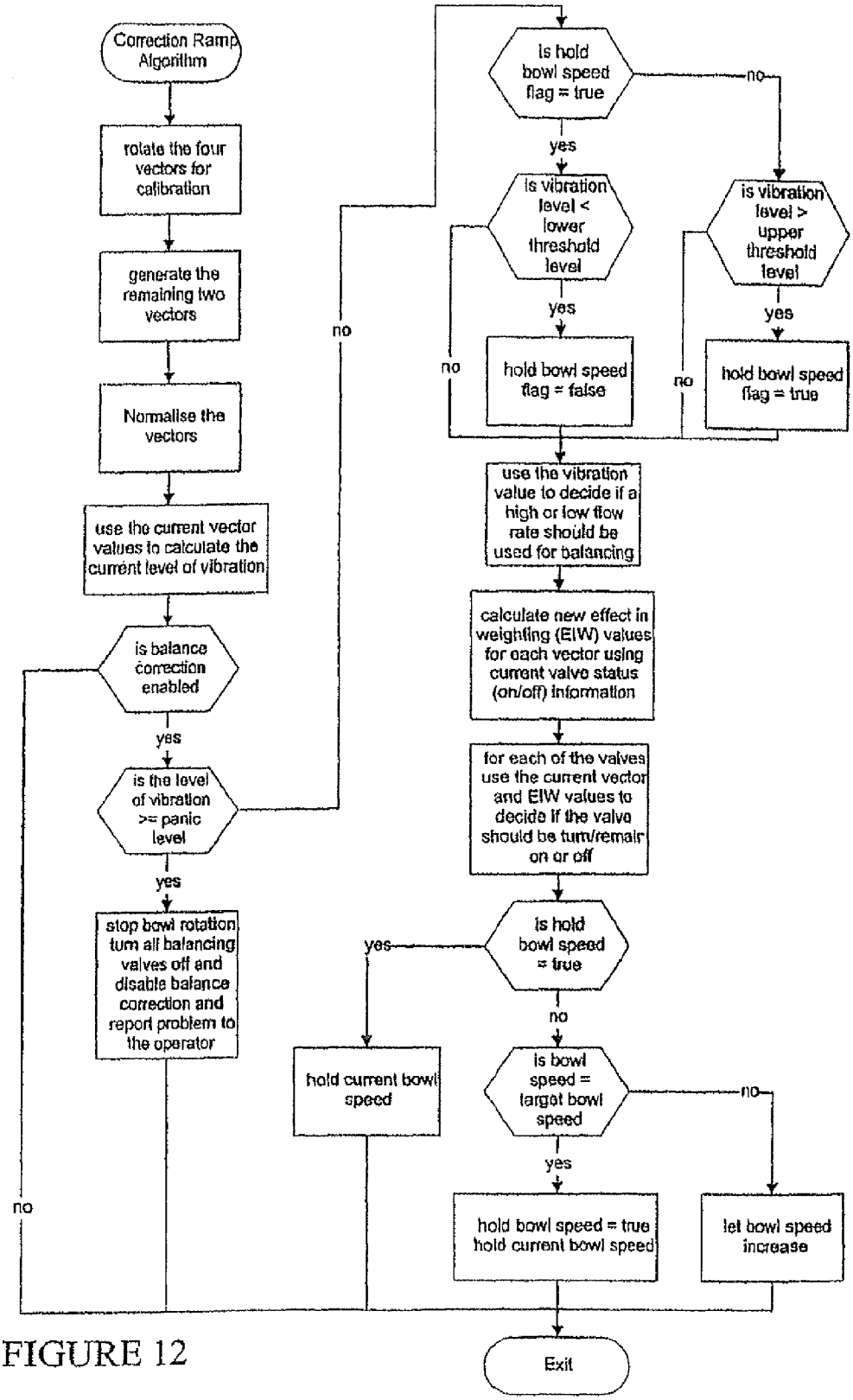
FIG. 12 is a flow diagram showing the Balance Correction Algorithm.

The Balance Control Algorithm (BCA) is active at times determined by the spin algorithm and is concerned with correcting whatever imbalance the IDA has determined. The BCA takes into account the time dependent behaviour of both the machine and the IDA. The BCA is active whenever the rotation speed of the machine is sufficient that the load is distributed on the walls of the drum and is believed to be reasonably evenly distributed greater than approximately 150 rpm. A preferred algorithm is illustrated in FIG. 12.

Overall Control Strategy—SA

In the exemplary embodiment the overall control over the spin process is assigned to the spin algorithm SA. It begins with the bowl speed at zero, and disables the BCA. Its first task is to better distribute the wash load to allow spinning to begin. If at a very low spin speed the vibration is below the initial threshold, it is allowed to spin to the minimum BCA speed at which point BCA is enabled. If the vibration is not below the threshold, redistribution is retried a number of times before stopping and displaying an error message. Once BCA has attained the target level of spin speed the spin is allowed to continue for the desired period after which the bowl is stopped, valves are closed and BCA is disabled.

Dynamic Control and the BCA

In the preferred embodiment of the invention a dynamic control method is used. This is not to be confused with static and dynamic imbalance as explained earlier. Dynamic control simply refers to the nature of the control methodology. The alternative control methodology is 'static'. A static control method does not make use of or retain data on the time dependent behaviour of its target system. As a result the method is executed as a 'single shot' attempt to restore equilibrium, and sufficient time must be allowed to lapse after each execution so that the system has returned to a steady state condition prior to the next execution. A dynamic control method anticipates the time dependent behaviour of the system and by storing recent past actions continuously corrects the system, even while the system is in transient response.

The main advantage of the preferred dynamic control is that the control loop can adjust for discrepancies when they appear rather than waiting for the next execution time to come round. For systems with slow time response this is a considerable advantage. To work effectively the controller is programmed according to an estimate of the time dependent response of the target system. However, this only needs to be roughly approximated. The dynamic controller preferably runs on a fast decision loop. Noise on the input parameters could result in many small corrections being made that are completely unnecessary. For this reason the preferred program includes a minimum threshold correction level before making a correction.

The main sources of time dependent behaviour include:

Given an instantaneous change in balance state of the machine, there will be a delay of a few revolutions to reach a steady state of vibration.

To compensate for instantaneous variation in sensor output, a forgetting factor type filter is applied to the load cell data acquisition, but this means that the averaged data also takes a number of revolutions to respond to a new vibration state.

Change in the balance state of the machine is never instantaneous; for example water addition requires anything from 0.1 to 60 seconds to occur and stabilise.

Water extraction from the load means the balance state of the machine may change quite rapidly as the spin speed increases.

If in the spin cycle the machine is to accelerate from 100 to 1000 rpm in about 3 minutes then the machine will almost certainly be in a state of transient response for the duration of this period. The present controller is able to respond to changes in the balance state of the machine without the machine ever being in a steady state condition.

For dynamic control the present controller is programmed with an approximation of the time dependent behaviour of the machine. The controller is programmed to consider past balance additions when deciding on what corrections, if any, are to be implemented. For each water chamber the sum of an appropriately weighted past history of water addition can be considered to be 'effect in waiting'. The controller program anticipates that the effect of a certain quantity of added water is still to come through on the signals. To compensate for this the controller subtracts an estimated 'effect in waiting' from the present out of balance vector when deciding which valves should be on and which should be off.

Figure 9:
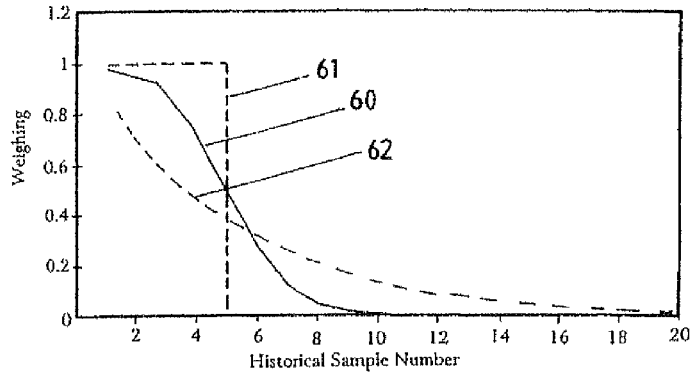
FIG. 9 is a graph illustrating the weighting curves.

To implement this controller maintains a record of the recent past actions. The history required depends on the machine mechanics, the sensors, and the imbalance calculation algorithm. For example with the configuration described here the controller tracks at least the last 10 seconds of activity. Preferably the controller records the present action each second. This would be each time the control loop executes or the control loop may execute much faster and updates could be more frequent, but greater in number The controller may record a series of data points relating to the valves that are on at each loop cycle, and a table of weighting values. If we call this number of points N, then to store the history of six control output channels with N points each requires 6N data points. Also, to then calculate the effect of this history will require 6N multiplications. One simplification would be to approximate the preferred weighting curve 60 with a 'table top' curve 61 as shown in FIG. 9. This then eliminates the need for a stored table of weighting values, and reduces the 6N multiplications to 6N additions.

An alternative embodiment uses a, negative exponential weighting curve 62 also shown in FIG. 9. For each water control channel, this is implemented by an "effect in waiting" variable. Each time the control loop executes, the effect in waiting variable is multiplied by a certain factor and an increment value is added to the variable if the water control valve for this channel was on during the last loop. This implementation only requires six multiplications and six additions with each control loop execution.

The factor is a forgetting factor, and is a value between zero and one. For example, this could be the effect of added balance water to be reflected in the calculated imbalance. Lower factors indicate rapid response. To avoid the need to have different forgetting factors dependent on speed, this part of the control loop could be executed on a per revolution basis. This is achieved by executing the balance control code the once per rotation with this approach directly after the data acquisition and conversion code. All quantities of water are calculated in terms of revolutions at the present speed rather than time, but this is a simple matter in that the magnitude calibration factor varies linearly with rotation speed.

If the out of balance load calculated for an end is directly opposite one of the chambers of that end then the data acquisition routine will identify this chamber as the primary one needing water. However, the algorithm may also determine that one of the other chambers needs a small amount of water as well. This second water requirement may be much smaller than the other one. If the balance control routine addressed these secondary small water requirements then over the relatively long period of addressing the primary chamber the controller as well as the primary chamber requirements, will also gradually fill the other chambers. This would negate some of the water going into the primary chamber, and leaving less headroom for further balancing corrections. Accordingly, in the preferred embodiment, the balance controller does not address two chambers at once at one end.

Figure 10:
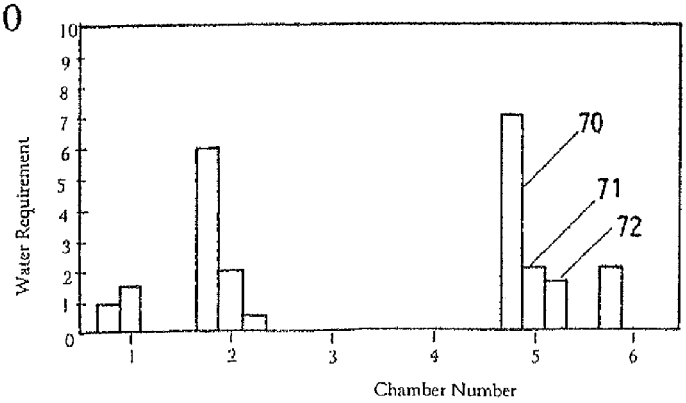
FIG. 10 is an illustration of the decision making process regarding filling of the balancing chambers.

The preferred controller is programmed to address this problem by identifying the maximum water requirement out of the six chambers and to then set a dynamic 'noise' threshold equal to half of this value of water. An example of this is illustrated in FIG. 10. In this example, for each chamber the left column illustrates the present demand resolved directly from the present imbalance. The centre bar indicates the present effect in waiting for that chamber. The right column indicates a value that is the present demand, less the dynamic noise threshold (half the greatest present demand), less the effect in waiting. So, in the example the present demand value 70 is 7. This also happens to be the highest demand value across the chambers so the dynamic noise threshold is set as 3.5 (0.5×7). The effect in waiting value 71 for chamber 5 is 2. The resultant 72 is 1.5 (7-3.5-2). A similar calculation is apparent for the other chambers showing a present demand value. Of these, only chamber 2 has any resultant. Following this calculation a valve will only be activated if the resultant for the chamber is above a further threshold value. This threshold is related to the amount of water that would be supplied before the next loop iteration. Our preferred controller performs a magnitude calibration by adjusting this threshold value in proportion to the drum speed.

A small amount of hysteresis is useful to prevent repetitive short valve actuations. This may be achieved by using the above criteria for deciding when to turn a valve on, but using different criteria when deciding to turn the valve off again. In the preferred control program the off criteria are straightforward: a water valve is turned off once its calculated present requirement is less than the valve of its effect in waiting variable. In other words once the valve is on it is not turned off until its chamber requirements are addressed, although other valves may turn on and off in the interim.

Dynamic Balancing—BCA

In more detail the balance correction algorithm shown in FIG. 12 begins with calibration of the phase information from the IDA. The step of vector rotation is optional depending on the method used (one alternative is to apply an offset to the sine table). Following this the vectors are normalised and the out of balance vectors are calculated. If the enable flag is true and the magnitude of the vectors is below a predefined critical limit the decision making process begins. Firstly the magnitude of the out of balance vectors is compared to a number of threshold values to assess whether to enable increase of the bowl speed. Then depending on the magnitude of the out of balance vectors or coarse (low or high flow rate to valves) correction is enabled. The effect in waiting values are updated to reflect the active values for the most recent cycle, and together with the current balancing demand vector information and the status of each valve a decision is made whether to open or close each valve. Then if the hold-bowl-speed-flat flag is not enabled i.e. acceleration is allowed, and the speed is not currently at the desired target level, the bowl speed is allowed to increase to the target level. At this point the BCA loops to the start and begins another iteration, effectively continuously correcting and accelerating until it reaches the target speed.

Signal Analysis—IDA Processing

To determine the imbalance in the load the IDA calculates the magnitude and phase angle of the once per rotation sinusoidal component in each of the signals. Unfortunately the signal does not look like a clean sinusoid, but is messy due to structural non-linearities in the machine as well as radio frequency interference (RFI). The controller program determines the once per rotation component or 'fundamental component' by digitally sampling the signal and using the discrete Fourier Transform technique. The preferred implementation does not compute an entire transform, but just the fundamental component. For example this may be done by multiplying each of the signal data points by the value of cosine wave (of the drum rotation frequency) at the equivalent phase angle lag after a rotational reference mark, summing each of these results over a whole revolution, and then dividing by the number of results. This gives one (eg: the x-axis) component of the vector result. The imaginary (or y) component is derived using the same technique but using sine wave valves instead of cosine wave valves. The resulting values may then be converted to polar form, giving magnitude and phase angle of the fundamental component in the signal relative to the reference mark.

The program may use any known method of deriving the magnitude and phase of the fundamental component of the sensor data. The example described is only one common technique.

In the preferred embodiment, to prevent aliasing, the input signal is passed through an analogue filter before processing to remove frequency components higher than half of the sampling frequency.

The discrete Fourier analysis is straightforward if the sampling is performed using a fixed number of samples per revolution rather than a fixed frequency. This requires rotational position data, which in this application is available from the motor controller. In the preferred embodiment the controller samples a number of points per revolution that divides exactly into the number of commutations per revolution executed by the motor. The sine values for the positions are stored as a table (termed the 'sine table'). The program retrieves the cosine values from the same table by offsetting forwards by a quarter of the number of samples per period.

Figure 8:
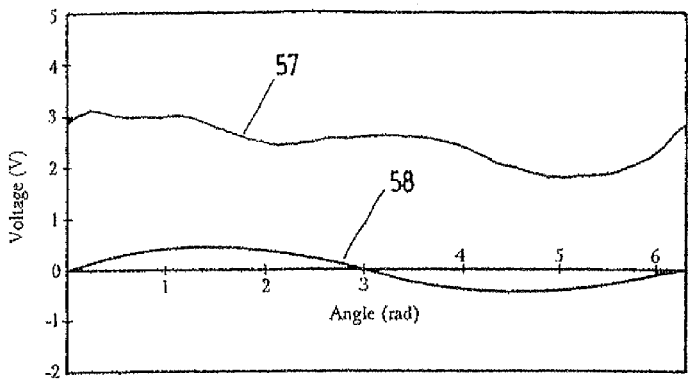
FIG. 8 is a waveform diagram giving example output waveforms from the vibration sensors.

It is useful to have a reasonable number of sampling points per revolution so that the order of harmonics that are aliased onto the fundamental component is well beyond the cut-off frequency of the low pass filter. Preferably the number of sampling points is at least 12 to obtain reliable sampling at speeds upwards of 200 rpm. Preferably there are an even number of points per revolution for sampling so that the sine table is perfectly symmetrical—the positive sequence and the negative sequence are identical apart from their sign. This ensures that the DC offset on the input signal does not influence the fundamental component. FIG. 8 illustrates the signal after filtering 57 and the extracted fundamental component 58.

Alternatively, if a sufficiently powerful microprocessor is available then by maximising its data acquisition capabilities the noise problem may be further reduced. This would mean instead of fixed sampling on a per revolution basis, it would be on a fixed frequency basis—at a higher rate. The sine and cosine valves could be either calculated or interpolated from a table, which simplifies much of the calculation.

Once the fundamental component of each of the source signals is obtained this will inevitably contain some noise component. Consecutive measurements will still have some variance. To minimise this the preferred signal source is accurate, clean, and has linear response. The program preferably uses averaging techniques to address any remaining noise.

In the preferred embodiment the control processor is programmed to implement a 'Forgetting Factor'. Every time a new measurement is acquired a new average is equal to a percentage of the old averaged value plus a reciprocal percentage of the new measurement. For example with a forgetting factor of 0.3, 0.3 of the old average is subtracted and replaced by 0.3 of the new measurement. This form of averaging suits a microprocessor based application since it is inexpensive with respect to both memory space and processor time.

The main disadvantage with averaging the measurements in this way is that the response time of the imbalance detection is reduced. The averaged result incorporates several measurements in order to reduce the noise. The lower the forgetting factor, the more the averaged value remembers from past measurements, and the more stable the value is, but the slower it responds to a change in machine vibration.

The imbalance of a load changes as water is extracted so balancing must be achieved over a long period. Accordingly we do not consider it necessary to be able to obtain a perfect balance in one 'hit'.

In the described embodiment the measurement data is processed to produce vectors in cartesian format (x & y), whereas the possible balancing responses are in polar format (magnitude & phase). While it could be possible to perform a format conversion conventionally, the preferred control program adapts a more efficient approach. The phases of the response are incorporated directly into the discrete Fourier technique as offsets each of an integer number of points when referencing the table of sine values. These offsets are adjusted as the machine changes speed for phase angle calibration. Alternatively phase calibration may be performed using a rotation matrix acting on the vectors as calculated without any applied offset to the sine table. Magnitude calibration however, is performed later in the dynamic control routine.

After obtaining an imbalance vector at each end of the drum, the IDA calculates how much water each chamber at each end needs. The chambers of the preferred embodiment are 120 degrees apart. The machine could include four chambers at each end 90 degrees apart, (i.e. orthogonal like the x and y axes) and then these would be the x and y components already calculated in the Fourier transform. However this would require four chambers for each end and thus two more water control valves and associated drivers than necessary. In the preferred embodiment the control processor calculates the projection of the signal vector onto axes that are 120 degrees apart, the same as the chambers.

The described Fourier technique uses sine and cosine wave forms to extract the orthogonal x and y projections. This follows quite naturally from the fact that a cosine wave is a sine wave that is has been shifted by 90 degrees. To split the signal vectors into projections that are 120 degrees apart the control program performs a similar calculation replacing the cosine wave form with a sine wave form that has been shifted by 120 degrees.

The phase calibrated signals now represent the projection of the imbalance onto the first two chambers. The control program finds the projection of the imbalance onto the third chamber using the vector identity that the sum of three vectors of equal magnitude and all spaced 120 degrees apart must be equal to zero. Hence the sum of all three projections must be zero, and the projection onto the third chamber is the negative of the sum of the projections onto the first two chambers. By adding half a rotation to the response phase angles the three values obtained are made to represent the projection of the restoring water balance required onto each balancing chamber.

Finally, at least one of these three projections will be negative, representing water to be removed from that chamber. This cannot be done in our present balancing system and so instead the control program adds a constant to all three numbers so that the most negative number becomes zero and the other two are positive.

Alternatively the control processor program may assume that the chamber whose angular extent includes the imbalance vector (or which is closest to the imbalance vector) will receive no water. The correction vectors for the other two chambers then should add to the imbalance vector to give zero.

The direction of these vectors is assumed to be radial toward the centre of the respective balance chamber arc. The magnitudes of the vectors are easily calculated by trigonometry.

Calculating the Out-of-Balance Force

Thus far we have not described in detail how the control processor calculates the out of balance force from the force sensor inputs, compensated for machine movement and drum precession.

Figure 14:
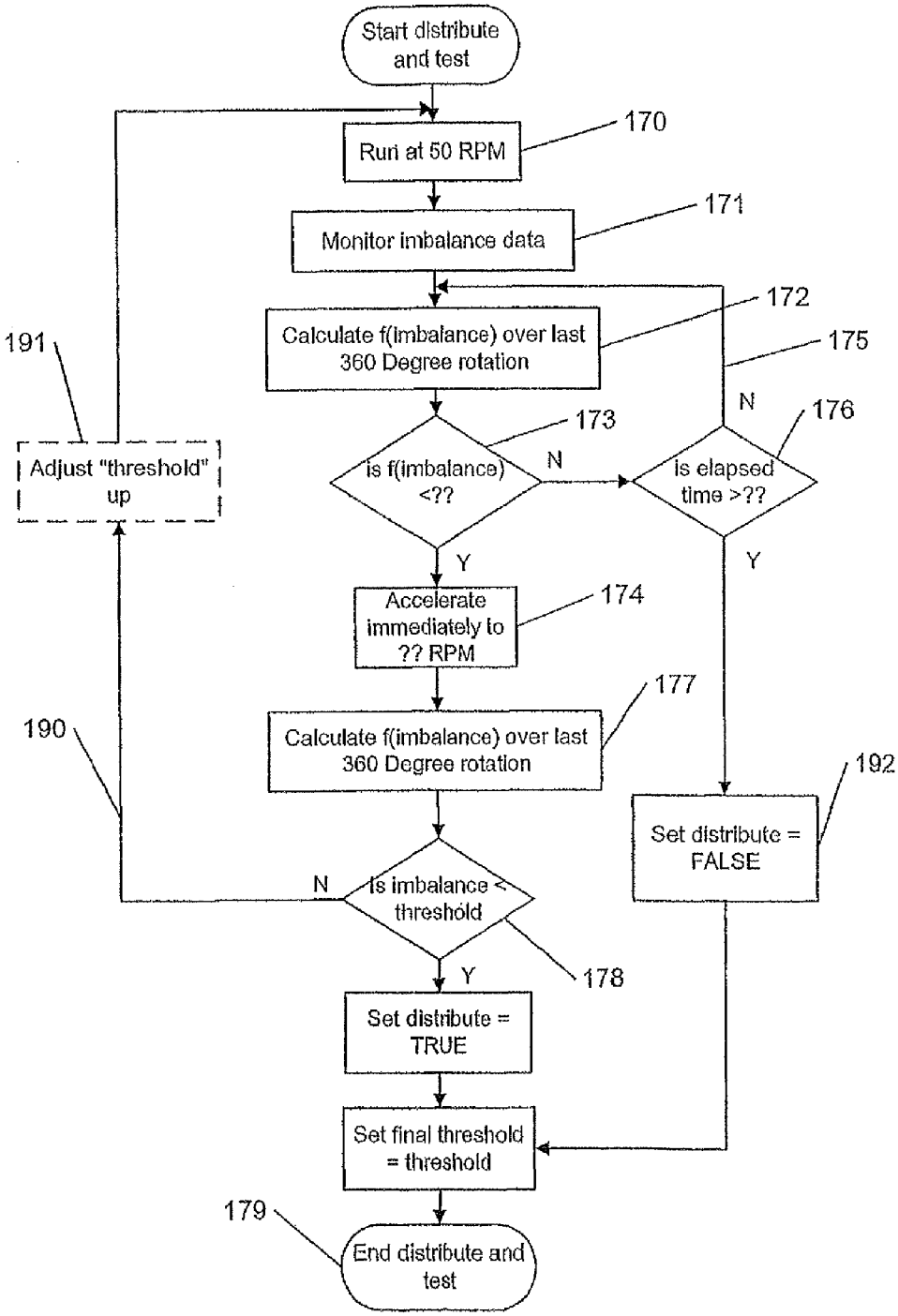
FIG. 14 is a flow diagram showing an embodiment of the 'Distribute and Test' algorithm.

The equivalent spring system which represents the spin drum 100, the machine frame 102 and the reference surface is shown in FIG. 14. The first spring 106 between the spring drum 100 and the machine frame 102 effectively represents the elasticity of the load bridge which connects the bearing mount to the drum support or frame of the washing machine. This bridge also forms the basis of the load cell which measures the forces between the drum and the frame of the washing machine. The second spring component 108 in this case represents the elasticity of the support surface, for example, flexible wooden floorboards, and the machine frame. The second spring 108 is complex and includes a damping component 110.

In the preferred embodiment of the invention to the sensor package measures the acceleration or displacement of the drum 100 at each end relative to the reference surface 104. For example a accelerometer 112 is connected either to a non-rotating part of the bearing itself or on an adjacent section of the load cell bridge. This accelerometer at each end measures accelerations in a vertical plane perpendicular to the drum axis.

Our U.S. Pat. No. 6,477,867 describes a balancing system that is capable of practical implementation and works acceptably up to moderate speeds, for example up to 1000 rpm. The entire content of U.S. Pat. No. 6,477,867 is hereby incorporated by reference.

Proposed active systems are distinguished from learning systems in that they implement a predetermined model of the operating force system. Force and acceleration date are provided as inputs to the algorithm implementing this model. The model outputs out of balance vectors or recommended balance correction data.

The most sophisticated prior active system for washing machines is disclosed in U.S. Pat. No. 6,477,867. The basic model implemented there uses a force sensor at either drum end. The model determines the out of balance force for each end as the rotating vector of the force sensor input waveform that is synchronised with the drum rotation.

The more complete mode described in U.S. Pat. No. 6,477,867 uses an additional accelerometer at each drum end. The accelerometer acts on the same axis as the force sensor measures movement of the support structure immediately adjacent the support axis of the drum. The model corrects the out of balance calculation by subtracting the direct forces applied by the moving support structure.

The present invention uses this out of balance data, or raw force data to make decisions in the early part of the spin cycle. This decision increases the likelihood that the load will be well distributed at the beginning of the spin phase.

Advantages

The advantages for the Washing Machine of employing an active balancing system are:

- Forces due to imbalance are eliminated prior to bearing assemblies. Thus structural requirements are reduced, enabling less and/or cheaper material to be employed.
- Suspension which wears out and deteriorates is eliminated.
- Wash cylinder clearances reduced enabling ample load capacity in a machine of standard size.
- Complexity of door opening mechanism also reduced because it no longer needs to cope with height changes on a suspension.
- Quiet smooth spinning at all times.

Distribute and Test Procedure

In accordance with the present invention the spin cycle includes a distribute and test procedure which involves selecting an appropriate moment to increase bowl (speed) from a tumbling speed.

At tumbling speed a load within the bowl is not held against the bowl sides by centrifugal forces throughout a bowl rotation and therefore undergoes a tumbling movement. As the bowl speed is increased to a slow spin (centrifugal speed), the clothes are held against the bowl by centrifugal forces throughout the rotation of the bowl. The criteria for selecting an appropriate moment to begin acceleration from a tumbling speed to a slow spin, will preferably provide an increased ratio of "balanced" load distributions to "imbalanced" load distributions when compared against the same ratio for randomly commenced accelerations. The 'distribute and test' algorithm is executed before the Balance Correction Algorithm in order to reduce the magnitude of the imbalance that needs to be compensated for.

Figure 16:
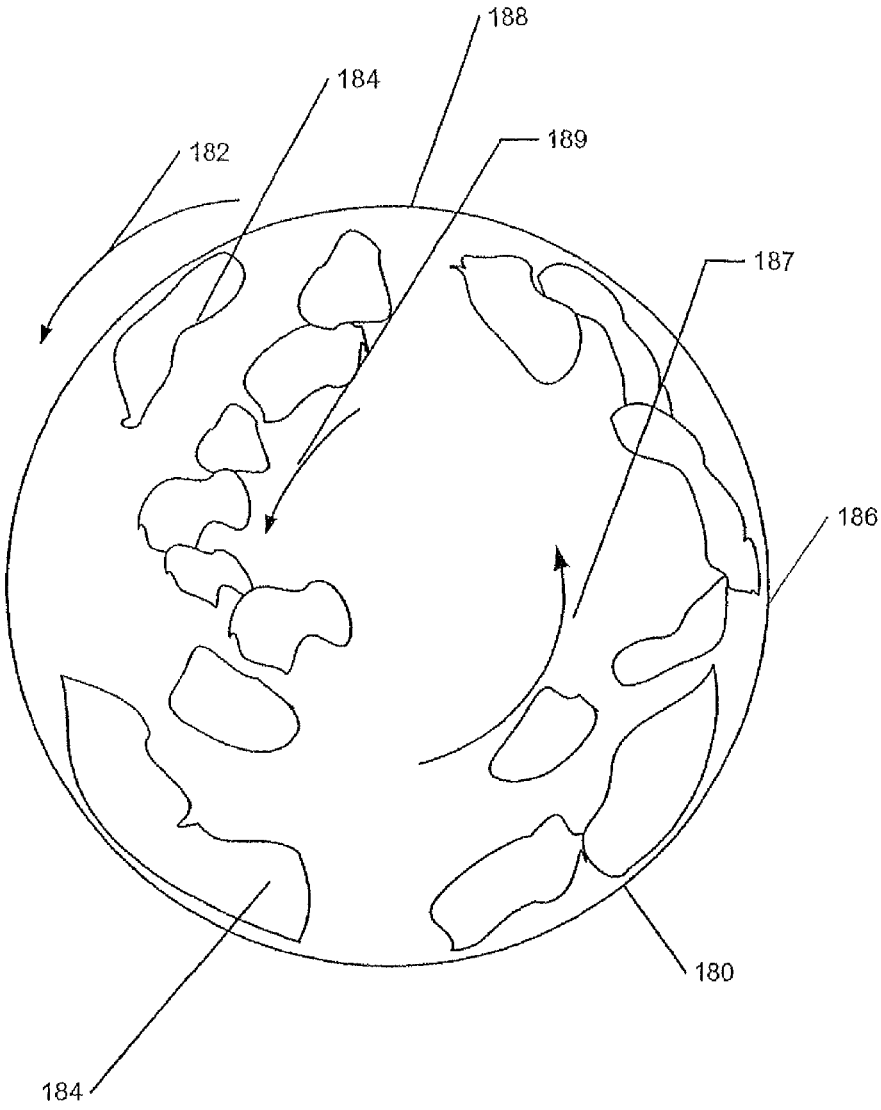
FIG. 16 is a diagrammatic representation of a wash load within a rotating drum.

Referring to FIG. 16 a general tumbling action of a clothes load within a bowl is represented. The bowl 180 is being rotated in a counter clockwise direction as indicated by arrow 182. The clothes load is carried upwards as indicated by arrow 187 by the rising side wall portion 186. The tumbling speed is insufficient to hold the clothes against the bowl surface throughout the rotation, and the clothes load falls from the upper surface portion 188 of the bowl as indicated by arrow 189.

It has been found that it is possible to select a tumbling speed in which the clothes will adopt a roll over tumbling action which will continue for a plurality of full bowl rotations. However the duration of this tumbling action is uncertain, and has been found to degenerate without warning from an even or distributed tumbling to a clumped tumbling within a fraction of a bowl rotation. In even or distributed tumbling, the clothes can be generally considered to occupy the perimeter portion of a cylinder and be evenly distributed throughout that portion. In the clumped formation the clothes tend to gather or collect into a single mass. Also seemingly without warning, the load may move from this clumped formation to the distributed formation.

It has also been found that if the bowl is spun up rapidly, beginning at an instant when the clothes load is in an even tumbling formation, then there is a greatly increased chance that the load will be evenly distributed when the bowl reaches the centrifugal speed. This will not always be achieved as it is possible for the load to revert to the clumped condition even during this short period of acceleration (usually less than a single revolution of the bowl). It seems to be possible for acceleration of the bowl to cause some collection of the instantly falling portion of the load as the bowl accelerates. Nonetheless commencing acceleration when the clothes are tumbling evenly gives a higher proportion of positive outcomes than commencing at a random moment.

The following describes two embodiments of a load distribution algorithm for increasing the probability of achieving a more uniformly distributed load when the centrifugal speed is reached. The embodiments vary in their effectiveness, but are suitable for different operating conditions and washing machine devices.

In a first embodiment of the present invention, an algorithm is provided that is suitable for a machine which is capable of providing quantitive imbalance data directly. This embodiment of the present invention is useful where the machine is capable of directly measuring imbalance of the drum. This data can then be used directly to determine an appropriate moment to accelerate the drum.

Referring to FIG. 14, a 'distribute and test' algorithm according to a first embodiment of the present invention is illustrated. At step 170 the controller initially runs the bowl at tumbling speed and at step 171 the controller monitors imbalance data. At step 172 the controller continuously calculates an imbalance factor from the imbalance data corresponding to the last 360 degree rotation, in a 'moving window' fashion.

At step 173 the controller compares the imbalance factor calculated at step 172 to a threshold. If the imbalance factor is not within the desired limits and the procedure has been running for less than the maximum desired time (step 176), then the controller loops back at step 175 to step 172. If the imbalance factor is within limits corresponding to an appropriately distributed load, the controller immediately (step 174) accelerates the drum to centrifugal or low spin speed, for example 150 rpm. At low spin speed the load is held against the bowl sides by centrifugal forces and is thus almost stationery relative to the bowl.

After the bowl is accelerated to low spin speed, a second imbalance factor is calculated by the controller at step 177, for the last 360 degree rotation of the drum. This step is necessary to ensure that the load has not redistributed during the acceleration from tumbling speed to low spin speed. At step 178 the controller compares the imbalance factor calculated at step 177 to a threshold. If the imbalance factor is not within the desired limits after the bowl has been accelerated, then the controller returns to the start of the 'distribute and test' procedure at step 190 and reduces the bowl speed back down to tumbling speed.

Alternatively, the loop back to the start may also include a step 191, to adjust the threshold. This optional step 191 is shown in FIG. 14 by a dotted box. This additional step may be implemented to alter the criteria for subsequent attempts to distribute the wash load after previous 'distribute and test' attempts have failed. Each subsequent attempt to balance the load may test the result against a higher threshold in order to increase the probability of a successful outcome. The raising of the threshold allows the pre balancing routine to achieve an appropriate trade-off between optimum balance and the time taken to achieve optimum balance.

If the imbalance factor calculated at step 177 is within the desired limits, then the controller sets and passes the appropriate variables to the next routine before terminating the 'distribute and test' procedure at step 179.

The 'distribute and test' procedure may also include a maximum time limit. If the 'Distribute and Test' procedure cannot produce a sufficiently uniform load distribution within a predetermined time limit (step 176), the procedure may set a flag (step 192) to indicate that the procedure was unsuccessful before the procedure terminates In a second embodiment an algorithm is provided that is suitable for a machine that provides quantitive data reflecting vertical forces acting on the bowl. This embodiment of the present invention is useful in machines where imbalance data is not directly available but where some force data is available. Some components of the force data generally correspond with impacts of individual items of the wash load on to the lower surface of the drum as they fall from the upper surface. It has been found that so long as the force sensors have a significant component of their response coming from forces in the vertical direction, then the impacts can be detected and effectively used to calculate a factor representing the uniformity of the wash load distribution throughout the drum.

Figure 15:
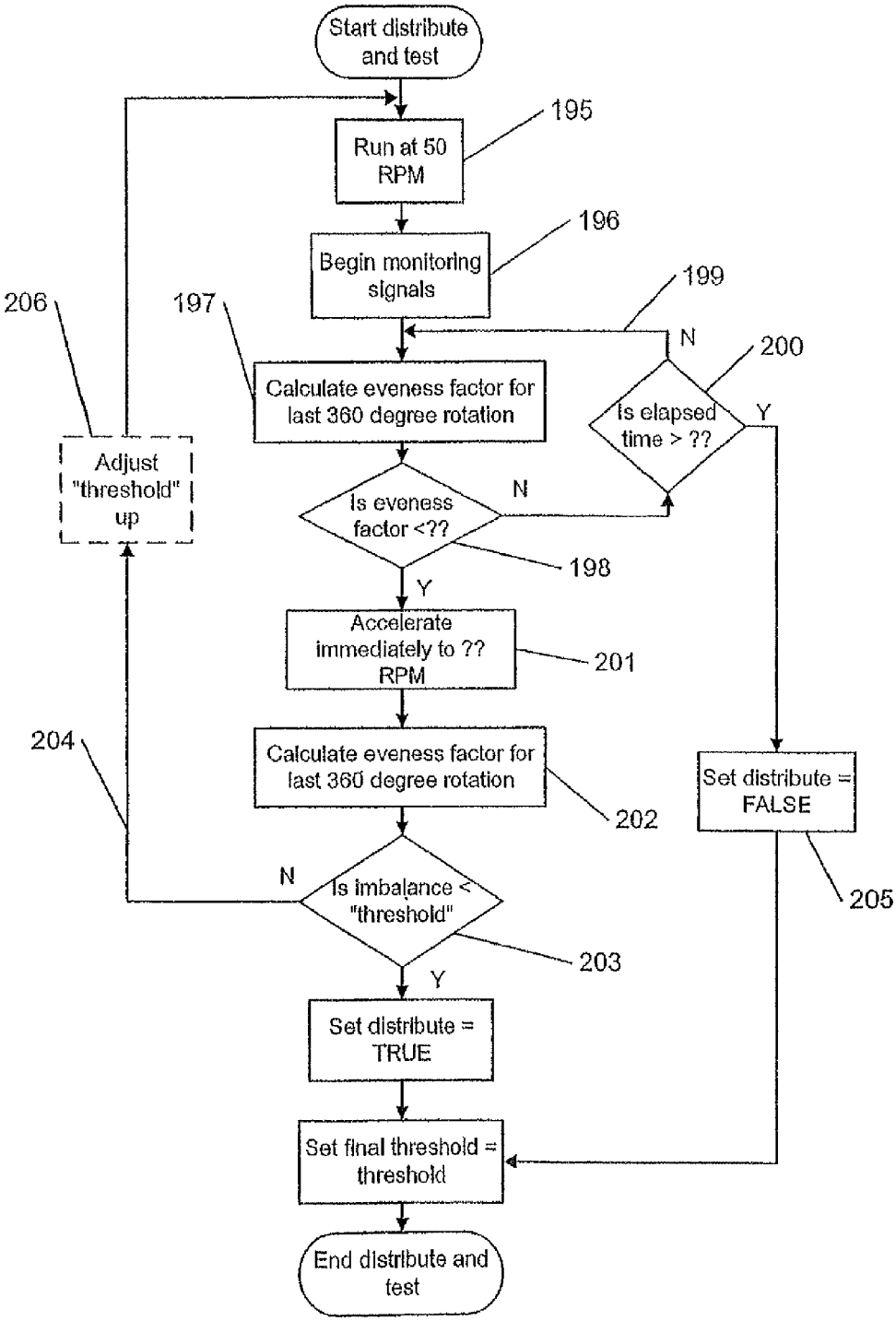
FIG. 15 is a flow diagram showing an alternative of the 'Distribute and Test' algorithm.

Referring to FIG. 15, an algorithm according to the second embodiment of the present invention is illustrated. At step 195 the bowl is initially run at tumbling speed with the controller at step 196 monitoring the output from various load sensors. At step 197 the controller calculates an evenness factor is for the last 360 degree rotation of the bowl which represents the balance/imbalance of the wash load within the drum. The evenness factor calculation is a continuous 'moving window' type calculation. At step 198 the controller compares the evenness factor calculated at step 197 to a threshold. If the evenness factor is not within appropriate limits and the maximum elapsed time has not been reached (step 200) the controller loops back at step 199 to step 197. After looping back the controller continues to run the bowl at tumbling speed and updates the evenness factor for the last rotation (step 197).

If the evenness factor calculated at step 197 is within the appropriate limits, the controller immediately accelerates the bowl to low spin speed at step 201. At low spin speed the load is held against the bowl sides by centrifugal forces.

After the bowl is accelerated to its target low spin rpm, the controller (at step 202) calculates an evenness factor for the last 360 degree rotation of the bowl. This step is to determine if the load has redistributed and become uneven during the acceleration of the bowl. At step 203 the controller compares the evenness factor calculated at step 202 to a threshold. If the imbalance factor is within acceptable limits the controller flags the 'distribute and test' routine as successful, passes appropriate variables for use by the next algorithm and terminates the distribute and test procedure. After the successful execution of the 'distribute and test' algorithm, the next step of the spin cycle illustrated in FIG. 13 is initiated.

If the evenness factor calculated at step 202 is not within appropriate limits, the controller returns to the beginning of the algorithm at step 204, where the bowl is run at tumbling speed (step 195) and attempts the 'distribute and test' routine again.

Alternatively, the loop back to the start may also include a step 206, to adjust the threshold. This optional step 206 is shown in FIG. 15 by a dotted box. This additional step may be implemented to alter the criteria for subsequent attempts to distribute the wash load after previous 'distribute and test' attempts have failed. Each subsequent attempt to balance the load may test the result against a higher threshold in order to increase the probability of a successful outcome. The raising of the threshold allows the pre balancing routine to achieve an appropriate trade-off between optimum balance and the time taken to achieve optimum balance.

The 'distribute and test' procedure may also include a maximum time limit. If the 'Distribute and Test' procedure cannot produce a sufficiently uniform load distribution within a predetermined time limit (step 200), the procedure may set a flag (step 205) to indicate that the procedure was unsuccessful before the procedure terminates While the previously described embodiments of the present invention calculate a factor representing the uniformity or evenness of the wash load for the threshold test, it is also envisaged that many other balance/imbalance detection methods may also be used. Any method where information representing the balance of the drum and wash load can be compared to an appropriate threshold has application with the present invention. Furthermore, like the second preferred embodiment, there are other ways of detecting the impacts of washing items, falling during tumbling. For example the falling items generate a slapping noise as they land. A sound transducer mounted over the drum may suitably provide an output to the processor. This output will include the noise of the wash load on top of a fairly constant or periodic background noise. Analysis of the output will allow the evenness of the tumbling load to be detected.

In the previously described 'distribute and test' algorithms, a factor representing a measure of 'evenness', is calculated while the drum rotates at tumbling speed and calculated again after acceleration of the bowl to centrifugal speed in order to check if the wash load has redistributed during acceleration. It is envisaged that the two steps comparing a measure of drum imbalance to a threshold may employ different methods. For example the threshold level may be different, the type of input data received from sensors may be different and the method of calculating the 'evenness' factor may also be different. The choice of an appropriate method may depend on the data available from a particular washing machine configuration or may be chosen to achieve optimum performance.

The invention claimed is:

1. A laundry appliance comprising:

a perforated rotatable drum for spin dehydrating a wet textile load, an electric motor for providing an accelerating force which in use causes said dram to rotate, load sensors for detecting a static or dynamic imbalance in the rotation of said drum, a controller which receives inputs from said load sensors and is programmed to, in a spin-up phase, energise said electric motor so as to evenly distribute the load within said drum and thereby minimise any static or dynamic imbalance when said drum rotates, wherein said controller is programmed to monitor said load sensors for a first condition during a low speed rotation of said drum in which said load is tumbling within said drum, and on detecting said first condition immediately accelerate said drum to a higher speed wherein said load is held centrifugally against the drum, wherein said controller is programmed with software which causes it to carry out the following steps:

(a) energise said electric motor to rotate said drum at a first predetermined rotational speed whereby said load is tumbling;

(b) monitor said load sensors;

(c) continually determine one or more characteristic indexes of said input from said load sensors;

(d) determine the presence of said first condition by comparing said indexes with a first criteria, and wherein said load sensors are arranged to sense a parameter being or indicative of at least one of acceleration, velocity, force, or displacement of said drum in at least two independent locations and said processor is programmed to detect, within a single revolution of said drum at said first speed, when the tumbling load within said drum is evenly distributed throughout the period of said rotation.

2. A laundry appliance as claimed in claim 1, wherein said first criteria is preset.

3. A laundry appliance as claimed in claim 1, wherein said controller programmed to monitor said load sensors after accelerating said drum to a second speed, and if the input from said load sensors indicates that said imbalance is greater than a predetermined threshold then said processor allows said drum to decelerate to said first speed and thereafter re-execute said spin-up phase.

4. A laundry appliance as claimed in claim 3, wherein said controller is programmed to repeat a cycle of executing said spin-up phase and detecting imbalance at said second speed until said imbalance at said second speed is less than a threshold value.

5. A laundry appliance as claimed in claim 4, wherein said threshold value is preset, but is modified upward after failure to reach a value below said threshold value.

6. A laundry appliance as claimed in claim 1, wherein said controller is programmed to calculate a measure of distribution of said imbalance for a moving time window corresponding at all times with the immediately preceding revolution of said drum.

* * * * *